US007093401B2

(12) United States Patent
Collins

(10) Patent No.: US 7,093,401 B2
(45) Date of Patent: Aug. 22, 2006

(54) LIGHT GAUGE METAL TRUSS SYSTEM AND METHOD

(75) Inventor: Harry J. Collins, Columbia, SC (US)

(73) Assignee: Renaissance Steel, LLC, Tampa, FL (US)

( * ) Notice: Subject to any disclaimer, the term of this patent is extended or adjusted under 35 U.S.C. 154(b) by 0 days.

(21) Appl. No.: 10/687,832

(22) Filed: Oct. 20, 2003

(65) Prior Publication Data

US 2004/0118072 A1 Jun. 24, 2004

Related U.S. Application Data

(62) Division of application No. 09/865,531, filed on May 29, 2001, now Pat. No. 6,658,809.

(60) Provisional application No. 60/207,200, filed on May 26, 2000.

(51) Int. Cl.
*E04C 3/30* (2006.01)

(52) U.S. Cl. ..... 52/731.7; 52/729.5; 52/673; 52/715; 428/596

(58) Field of Classification Search ..... 52/712, 52/715, 717.06, 731.7, 739.1, 737.6, 729.5, 52/634, 635, 673, 660; 428/596, 597, 577, 428/578, 580; 211/191, 192
See application file for complete search history.

(56) References Cited

U.S. PATENT DOCUMENTS 1,130,722 A * 3/1915 Fletcher ..... 52/355
2,054,703 A * 9/1936 Little ..... 405/43
2,064,910 A * 12/1936 Harper ..... 52/335
2,105,771 A * 1/1938 Holdsworth ..... 52/290
2,311,300 A 2/1943 Dubour et al.
2,477,163 A 7/1949 Barnett
2,638,637 A 5/1953 Kump, Jr.
2,704,868 A * 3/1955 Danielson ..... 52/210
2,768,434 A 10/1956 Taylor
2,770,846 A 11/1956 Findleton
3,019,866 A * 2/1962 Grabowski ..... 403/4
3,137,098 A 6/1964 Elia et al.
3,144,945 A * 8/1964 Seiz ..... 211/192
3,303,937 A * 2/1967 McConnell ..... 211/192
3,423,898 A * 1/1969 Coloney et al. ..... 52/713
3,656,270 A 4/1972 Phillips
3,760,550 A 9/1973 Mueller et al.
3,785,108 A 1/1974 Satchell (Continued)

FOREIGN PATENT DOCUMENTS

DE 3743970 A1 * 7/1989

(Continued)

*Primary Examiner*—Naoko Slack
(74) *Attorney, Agent, or Firm*—Duane Morris LLP

(57) ABSTRACT

A truss system wherein the structural components and fixtures are formed from light gauge metal. The trusses are fabricated from roll formed truss chord members and truss web members. The truss chord members are roll formed to have a generally U-shaped cross-section with a base and two substantially parallel legs with recessed web attachment faces and outwardly extending stiffening flanges to improve structural capacity thus improving the strength-to-weight ratio of the chord member and minimizing costs. The truss web members are formed by nesting two roll formed C-shaped members to form a web member which is box-shaped in cross section. The web members provide the structural advantages of a box-shaped member and the ease and flexibility of a roll formed member. The truss system and method provides improved means and methods for positioning and attaching the web members to the chord members as well as improved truss clips for resistance to uplifting forces and improved truss jack clips for forming hip connections.

12 Claims, 12 Drawing Sheets

U.S. PATENT DOCUMENTS

| | | | | | |
|---|---|---|---|---|---|
| 3,845,594 | A | | 11/1974 | Butts et al. | |
| 3,956,864 | A | * | 5/1976 | Fung | 52/414 |
| 4,201,021 | A | | 5/1980 | Aldag et al. | |
| 4,329,824 | A | | 5/1982 | Lowe | |
| 4,435,940 | A | | 3/1984 | Davenport et al. | |
| 4,513,551 | A | * | 4/1985 | Gauffin et al. | 52/364 |
| 4,616,453 | A | | 10/1986 | Sheppard, Jr. et al. | |
| 4,688,358 | A | * | 8/1987 | Madray | 52/93.2 |
| 4,720,957 | A | | 1/1988 | Madray | |
| 4,773,192 | A | | 9/1988 | Andrews | |
| 4,878,323 | A | | 11/1989 | Nelson | |
| 4,974,387 | A | | 12/1990 | Dufour | |
| 4,982,545 | A | | 1/1991 | Stromback | |
| 4,986,051 | A | | 1/1991 | Meyer et al. | |
| 4,986,052 | A | | 1/1991 | Nelson | |
| 5,010,709 | A | | 4/1991 | Paz | |
| 5,157,883 | A | | 10/1992 | Meyer | |
| 5,417,028 | A | | 5/1995 | Meyer | |
| 5,457,927 | A | | 10/1995 | Pellock et al. | |
| 5,463,837 | A | | 11/1995 | Dry | |
| 5,625,995 | A | * | 5/1997 | Martin | 52/715 |
| 5,771,653 | A | | 6/1998 | Dolati et al. | |
| 5,854,747 | A | | 12/1998 | Fairlie | |
| 5,857,306 | A | | 1/1999 | Pellock | |
| 5,865,008 | A | | 2/1999 | Larson | |
| 5,884,448 | A | * | 3/1999 | Pellock | 52/643 |
| 5,946,879 | A | | 9/1999 | Pellock | |
| 5,970,678 | A | | 10/1999 | Pellock et al. | |
| 5,996,303 | A | | 12/1999 | Pellock | |
| 6,009,681 | A | | 1/2000 | Kozloff | |
| 6,073,414 | A | | 6/2000 | Garris et al. | |
| 6,374,558 | B1 | * | 4/2002 | Surowiecki | 52/241 |

FOREIGN PATENT DOCUMENTS

| | | |
|---|---|---|
| FR | 939599 | 11/1948 |
| GB | 2062060 | 5/1981 |
| GB | 2247033 | 2/1992 |
| JP | 6057878 | 3/1994 |
| SZ | 418608 | 2/1967 |

* cited by examiner

LIGHT GAUGE METAL TRUSS SYSTEM AND METHOD

CLAIM OF PRIORITY

This Application is a divisional of and claims benefit of application Ser. No. 09/856,531 filed May 29, 2001 now U.S. pat. No. 6,658,809 entitled "LIGHT GAUGE METAL TRUSS SYSTEM AND METHOD", which claims the benefit of U.S. Provisional Patent Application Ser. No. 60/207,200, filed May 26, 2000.

BACKGROUND OF THE INVENTION

The present invention relates to a truss system used in the construction of commercial and residential buildings. More particularly, the present invention relates to a truss system using roll-formed light gauge metal truss members and fixtures.

In the construction field, structural members and fixtures are increasingly formed from light gauge metal due to the rising cost and declining quality of wood. Components formed from light gauge metal are preferred over wood in many applications because the metal components are lighter in weight, stronger, consistent in quality, not subject to shrinkage, and resistant to fire and insect infestation.

In producing the most economical light gauge metal truss system, it is desirable to roll form the elongated truss members with a cross-sectional configuration designed to achieve maximum strength of the member to meet the required structural codes while minimizing the weight of the metal used. A number of roll-formed light gauge metal truss chord members have been developed having different cross-sectional configurations. Typically such truss members have been formed with C-shaped or Z-shaped cross-sections which suffer from low strength-to-weight ratios. More recently, truss members have been formed with generally U-shaped cross-sections having a pair of substantially parallel legs extending from a base portion.

U.S. Pat. No. 4,986,051 to Meyer et al. dated Jan. 22, 1991; U.S. Pat. No. 5,417,028 to Meyer dated May 23, 1995; and U.S. Pat. No. 5,771,653 to Dolati et al. dated Jun. 30, 1998, each disclose an elongated truss chord member of light gauge metal having a generally U-shaped cross-section. The prior art chord members include in cross-section a pair of legs extending from a base portion. Each of the legs includes a recessed web attachment face so that the pair of web attachment faces are spaced apart a distance less than the width of the base portion. The legs terminate in an outwardly turned stiffening flange to improve the strength-to-weight ratio of the members. The outwardly turned stiffening flange also provides an outer face adjacent the distal end of each leg so that the cross-sectional width of the chord members at the base portion is substantially the same as the cross-sectional width of the chord member at the distal end of the legs to facilitate stacking and transport of the trusses, and engagement of the truss chord members with other structural members or fixture.

The prior art teaches the use of an inclined face in the portion of the chord member interconnecting the recessed web attachment face with the base. The inclined faces in each leg extend inward toward the opposite leg so that the web attachment faces are spaced apart a distance less than the width of the base. Truss chord members including inwardly extending inclined faces to interconnect the web attachment face and the base have several drawbacks. For example, it is desirable in a truss chord member to provide a wide web attachment face to thereby facilitate the attachment of the chord member to structural members received between the web attachment faces. In a member including an inwardly extending inclined face interconnecting the web attachment face and the base, the inclined face comprises a portion of the overall longitudinal width of the leg, thus the longitudinal width of the web attachment face relative to the overall longitudinal width of the leg is reduced.

Further by way of example, the angle of the inclined portion relative to the base may cause difficulties in engaging the chord member with truss clips and other fixtures.

A typical truss includes a plurality of truss web members interconnecting the truss chord members. A number of roll-formed light gauge metal truss web members have been developed having different cross-sectional configurations. Typically such web members have been formed with a C-shaped or H-shaped cross-section which suffer from low strength-to-weight ratios. Truss web members having a box-shaped cross section are favored because the box-shaped cross-sectional configuration eliminates two modes of failure of the members in compression compared to C-shaped or H-shaped members. However, box-shaped members are difficult to fabricate which adds to the expense of fabricating the truss and reduces the flexibility in providing trusses of differing dimensions.

It is known to fabricate a box-shaped member by nesting two C-shaped members. French Patent No. 939,599 dated Jan. 8, 1947, discloses an elongated member having a box-shaped cross section formed by nesting two elongated C-shaped members each having one longer flange and one shorter flange. The above-referenced French patent does not disclose or suggest structural members having sufficient size and strength to bear the loads subjected to a web member in a long span truss. Heretofore, such two-piece box-shaped members have not been made in such sizes or used as load bearing web members in trusses.

Accordingly, it is an object of the present invention to provide a novel truss system in which the structural members and fixtures are formed from light gauge metal.

It is another object of the present invention to provide a novel truss chord member which is easily roll formed having a cross-section that optimizes the strength of the member for the weight of the metal used.

It is another object of the invention to provide a truss system with truss chord members having wide web attachment faces.

It is still another object of the invention to provide a truss system with truss chord members which easily engage truss clips and other fixtures.

It is a further object of the invention to provide a truss system with truss chord members which are easily stacked and nested for efficient shipment.

It is yet another object of the present invention to provide a novel truss web member that is easily roll formed having a cross-section that optimizes the strength of the member for the weight of the metal used and provides flexibility in sizing for different size truss chord members.

It is still another object of the present invention to provide a novel truss web member having a box-shaped cross section that may be easily roll formed in different sizes.

Trusses are typically fabricated with upper and lower truss chord members and a plurality of interconnecting web members. Each of the web members having one end attached to an upper chord member and the other end attached to a lower chord member. The number and location of the web members is determined by the type of truss being fabricated and the structural requirements for the truss.

In the fabrication of trusses, the various members may be attached to each other by conventional means. Typically, the end portion of a web member is received between the web attachment faces of the chord member and attached thereto by self tapping screws or other conventional means. It is known to provide one or more pre-positioned holes along the length of structural members to facilitate the attachment of the members by screws or other conventional attachment means. U.S. Pat. No. 4,720,957 to Madray discloses a series of pre-positioned holes formed along the entire length of a C-shaped structural member. However, in the fabrication of trusses it is not necessary or desirable to pre-position holes along the entire length of the chord member. The pre-positioned holes need only be located along the portions of the chord member where a web member will be attached. Limiting the pre-positioned holes to one or more portions along the length of the chord member reduces the time and expense associated with forming the holes and provides an additional aid in properly positioning the web members.

Accordingly, it is an object of the present invention to provide a novel truss system and method of fabricating trusses which obviate the deficiencies of the known systems and methods.

It is another object of the present invention to provide a novel apparatus and method for positioning web members in a light gauge metal truss.

It is yet another object of the present invention to provide a novel apparatus and method for roll forming truss chord members from a blank of light gauge metal.

It is still another object of the present invention to provide a novel apparatus and method for forming the peak of a light gauge metal truss.

It is a further object of the present invention to provide a novel apparatus and method for securing a truss from uplifting forces.

It is yet a further object of the present invention to provide a novel apparatus and method for connecting one or more trusses together.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

The present invention is directed to truss systems wherein the structural members and fixtures are formed from light gauge metal. The gauge of the metal may vary depending upon the specific application, but is typically selected from the gauges of metal including 10, 12, 14, 16, 18, 20, and 22.

Figure 1:
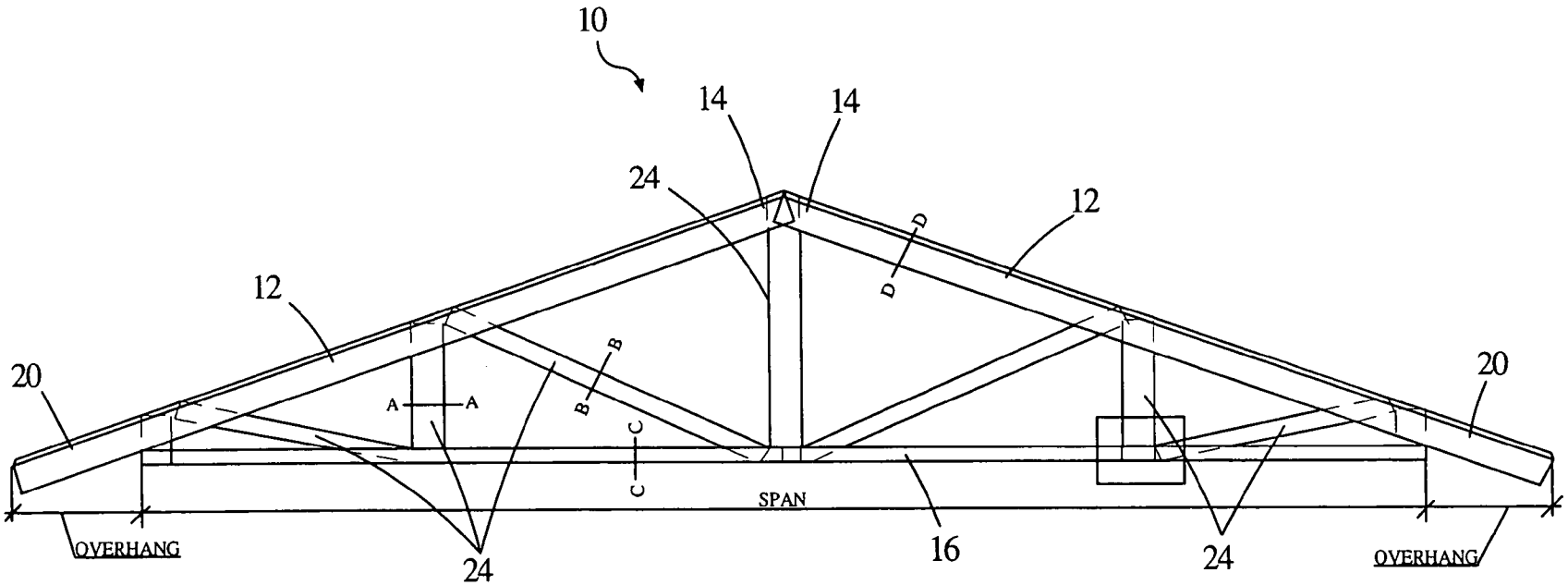
FIG. 1 is an illustration of a truss formed from light gauge metal components.

FIG. 1 illustrates a truss according to one aspect of the present invention. With reference to FIG. 1, the truss 10 is formed by coupling a pair of upper truss chord members 12 at the upper ends 14 thereof to form a peak. A lower chord member 16 is coupled at each end 18 thereof to the lower end 20 of one of the upper chord members 22. A plurality of web members 24 interconnect the upper and lower chord members 12,16. Each of the web members 24 is coupled at one end to an upper chord member 12 and at the other end to the lower chord member 16.

Figure 2:
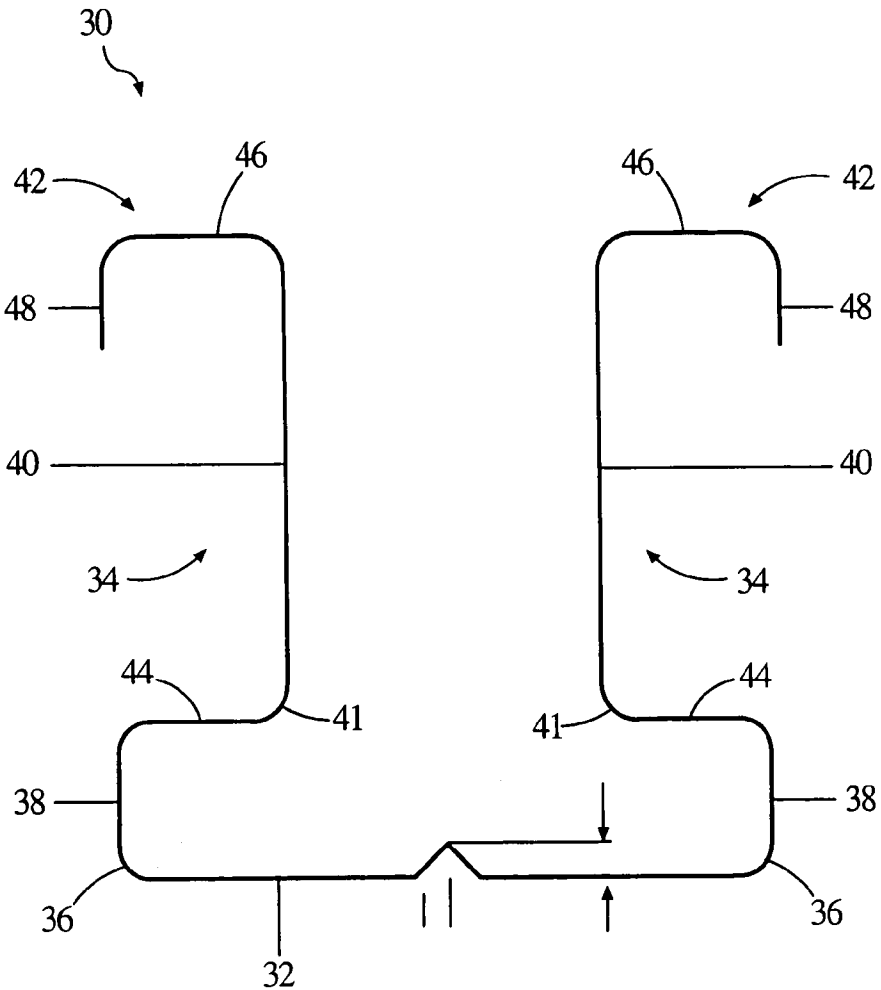
FIG. 2 is an illustration of one embodiment of an elongated structural chord member in cross section according to the present invention.

FIG. 2 illustrates one embodiment of an elongated truss chord member according to the present invention. With reference to FIG. 2, the truss chord member 30 is an elongated structural member having a generally U-shaped cross section. The chord member 30 comprises in cross section a base 32 and two substantially parallel legs 34 extending from the longitudinal edges 36 of the base 32 at a substantially right angle thereto. Each of the legs 34 comprises a first outer face 38, a recessed web attachment face 40, and a stiffening flange 42 extending from the distal end of the web attachment face 40. A lateral face 44 extending outward from the longitudinal edge of the web attachment face 40 adjacent the base 32 at a substantially right angle thereto interconnects the web attachment face 40 with the first outer face 38.

The stiffening flange 42 includes a lateral face 46 extending outwardly from the distal longitudinal edge of the web attachment face 40 at a substantially right angle thereto and an outer flange face 48 extending from the outer edge of the lateral face 46 toward the base 32. The first outer face 38 and the outer flange face 48 are substantially coplanar so that the cross-sectional width of the chord member 30 is substantially the same at the base 32 and the distal ends of the legs 34. The coplanar outer faces 38,48 provide ease of stacking or nesting for transport of the chord members or assembled trusses, and ease of engagement of the members with other structural members and/or fixtures.

The chord member 30 comprises in cross section a base 32 and a pair of web attachment faces 40 spaced apart a distance less than the width of the base 32. The channel formed by the base 32 and the legs 34 is commonly referred to as the "throat" of the chord member and the distance between the web attachment faces is the width of the throat. The distance from the base 32 to the distal ends of legs 34 is the depth of the throat.

Heretofore, light gauge metal truss chord members have not been made with a throat width greater than one and one-half inches. According to one aspect of the present invention, light gauge metal truss chord members are provided having larger than one and one-half inches to provide the required structural capacity for larger span trusses. According to the present invention, the throat may be as wide as two and one-half inches or even wider if the specific application requires.

The overall longitudinal width of the legs 34, i.e., the depth of the throat, may vary according to the specific application. Typically, the depth of the throat may be as shallow as two and one-half inches or as deep as five inches. Other throat depths may be required depending on the specific application. The ratio of the depth of the throat relative to the width of the base may also vary depending on the specific application. The ratio may be greater than one for some applications, or less than one in other applications.

Each leg includes a web attachment face 40 having a lateral face 44 extending from the longitudinal edge 41 of the web attachment face 40 adjacent the base 32 at a substantially right angle thereto. The chord member of the present invention is a significant improvement over the prior art chord members due to the substantially right angle of the lateral face 44 relative to the web attachment face 40 and the first outer face 38. By extending the lateral face 44 from the web attachment face 40 at a substantially right angle as opposed to extending the face at an incline as taught by the prior art, the longitudinal width of the web attachment face 40 relative to the longitudinal width of the leg 34 is increased. A further advantage results from moving more of the mass of the member away from the axis of the member which improves the resistance to bending. Thus a wide web member having improved resistance to bending is provided.

The stiffening flanges 42 provide added structural capacity to the member as well as further providing mass away from the axis of the member. Much of the mass of the member 30 is moved away from the axis of the member similar to an I beam thus improving the resistance to bending of the member. The stiffening flanges 42 also extend laterally from the distal edge 43 of each web attachment face 40 so that the longitudinal width of the web attachment face is maximized to provide a wide attachment face.

Figure 3:
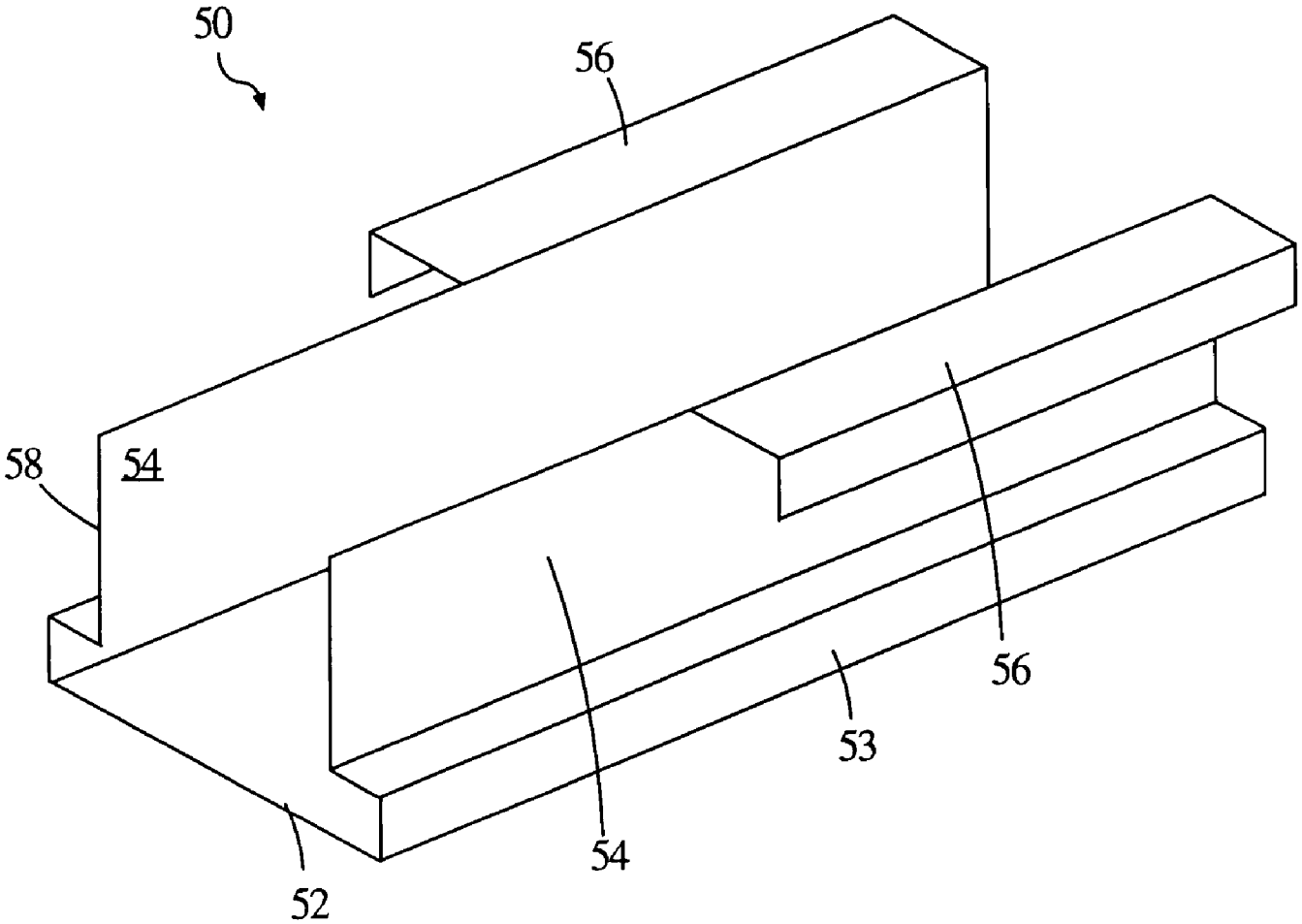
FIG. 3 is a pictorial view of one embodiment of an elongated structural chord member according to the present invention.

FIG. 3 illustrates another embodiment of an elongated structural chord member according to the present invention. With reference to FIG. 3, the chord member 50 comprises in cross section a base portion 52 and a pair of substantially parallel web attachment faces 54 extending from the base portion 52 at a substantially right angle thereto. The web attachment faces 54 are spaced apart a distance less than the cross-sectional width of the base portion 52. Each of the web attachment faces 54 terminates in an outwardly extending stiffening flange 56 for at least a portion of the length thereof. The stiffening flange 56 may extend along the entire length of the web attachment face 54, or the stiffening flange 56 may extend along only a portion of the length of the web attachment face 54. In the embodiment illustrated in FIG. 3, the stiffening flange 56 terminates at a point spaced from the end 58 of the chord member 50.

Figure 4:
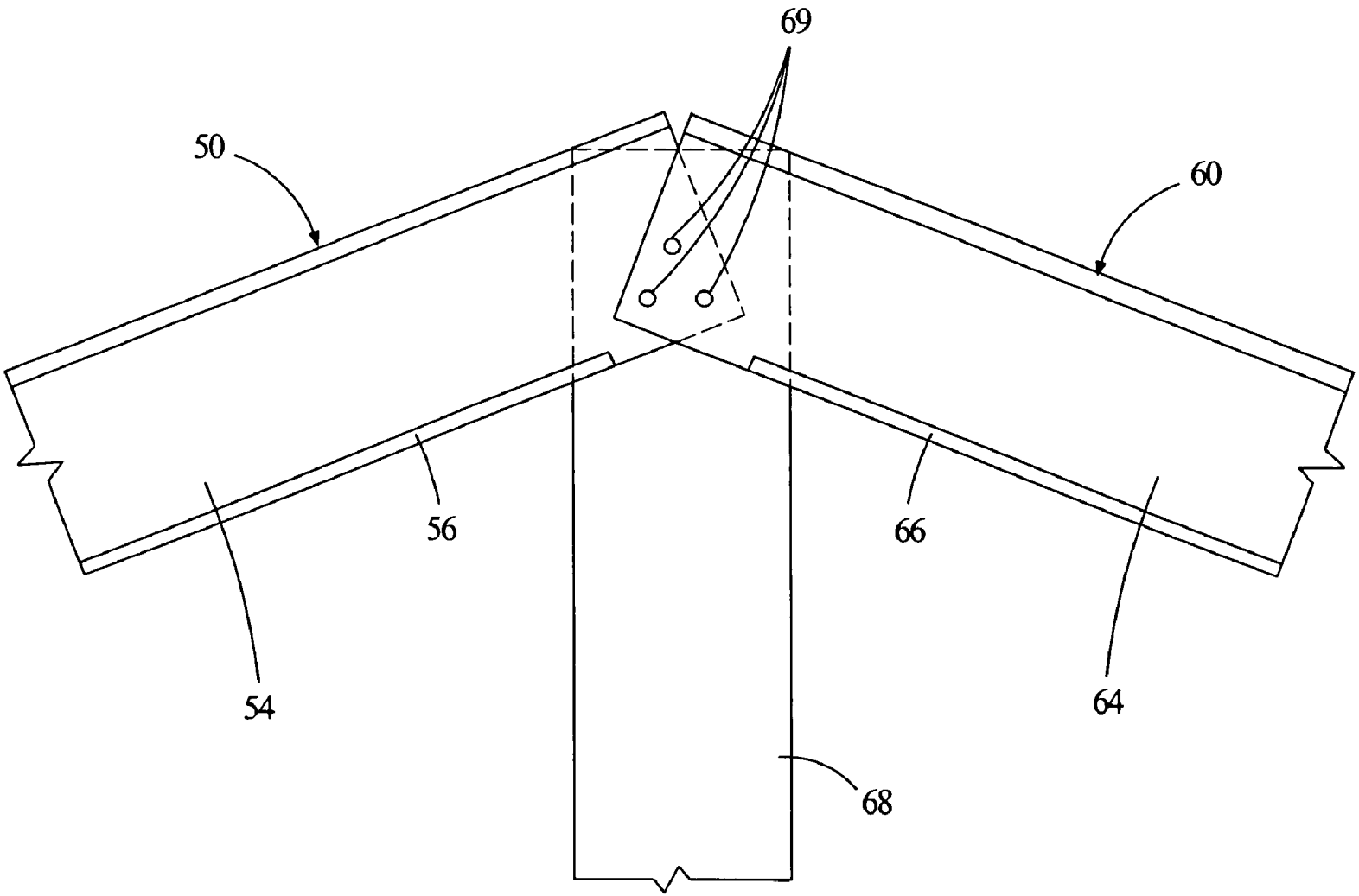
FIG. 4 is an illustration of one embodiment of a peak formed in a truss according to the present invention.

FIG. 4 illustrates a peak in a truss formed by two chord members according to one aspect of the present invention. With reference to FIG. 4, the stiffening flange 56 terminates at a point spaced from the end 58 of a first chord member 50. The web attachment faces 54 of the first chord member 50 may then be received within the throat of a second chord member 60 so that a portion of the web attachment faces 64 of the second chord member 60 overlie a portion of the web attachment faces 54 of the chord member 50 received therebetween. The overlying web attachment faces 54, 64 provide two thicknesses of light gauge metal on each side of the throat for secure attachment to a web member 68 received therein. Thus, including the web member, the attachment means 69 pass through three thicknesses of metal on each side of the throat formed by the overlying web attachment faces 54,64 to thereby provide secure coupling of the chord members 50,60 and the web member 68 in forming the truss peak. In addition to providing secure coupling of the members, the web member 68 gussets the peak to thereby eliminate the need for a gusset plate in forming a pitch break or peak in a truss.

It is necessary in the fabrication of trusses to properly position the web members relative to the chord members. To facilitate the proper positioning of the web members, it is desirable to identify the proper position of the web members along the length of the chord members prior to the steps of positioning and attaching the web members in the fabrication of a truss. It has been discovered that the proper position of the web members may be determined during the design of the truss and that the proper position along the length of the chord member for attachment of the web members may be identified along the length of the blank before the chord member is roll formed.

Figure 5:
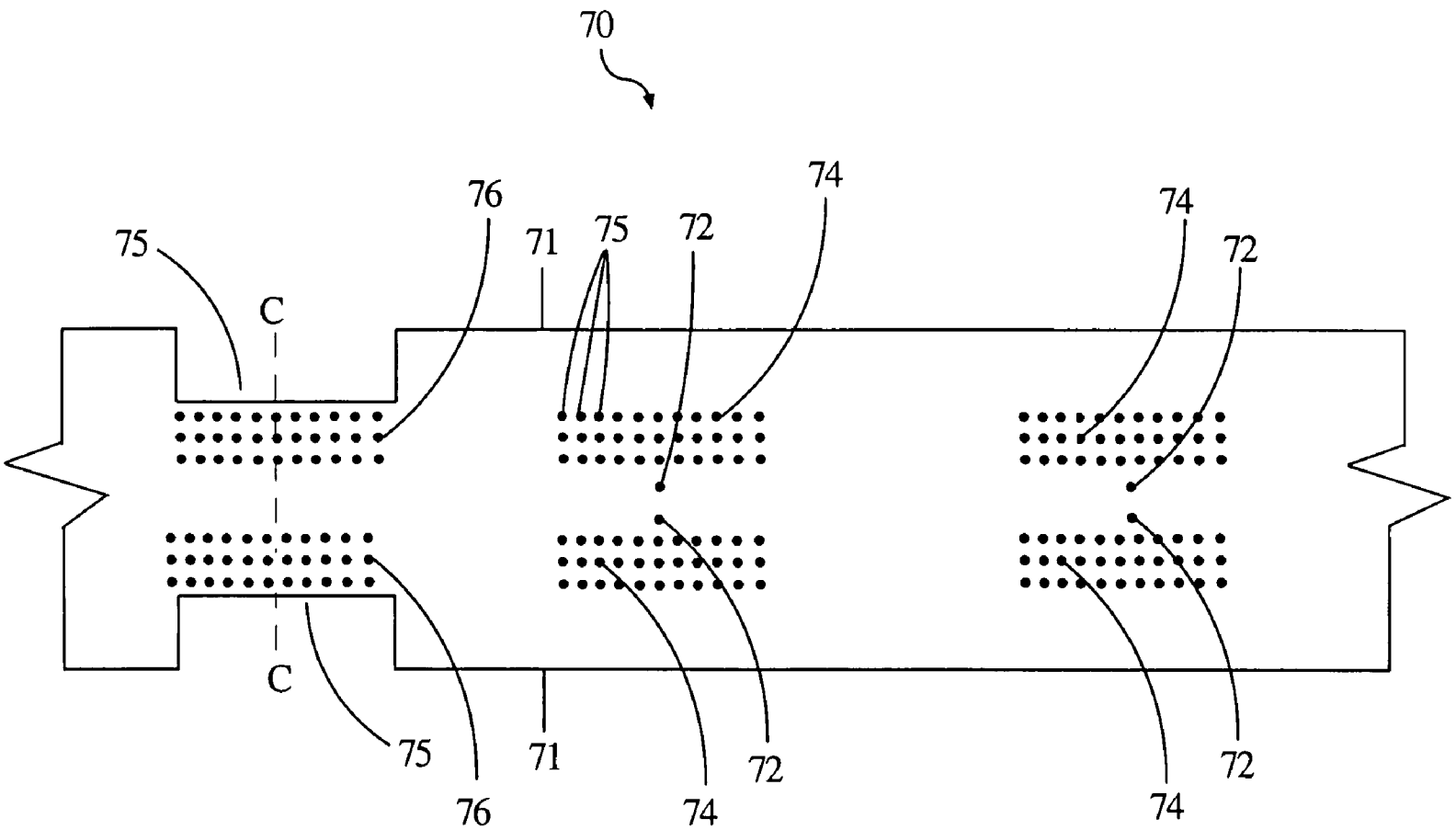
FIG. 5 is an illustration of a section of a light gauge metal blank from which one or more elongated structural chord members may be formed according to the present invention.
Figure 6:
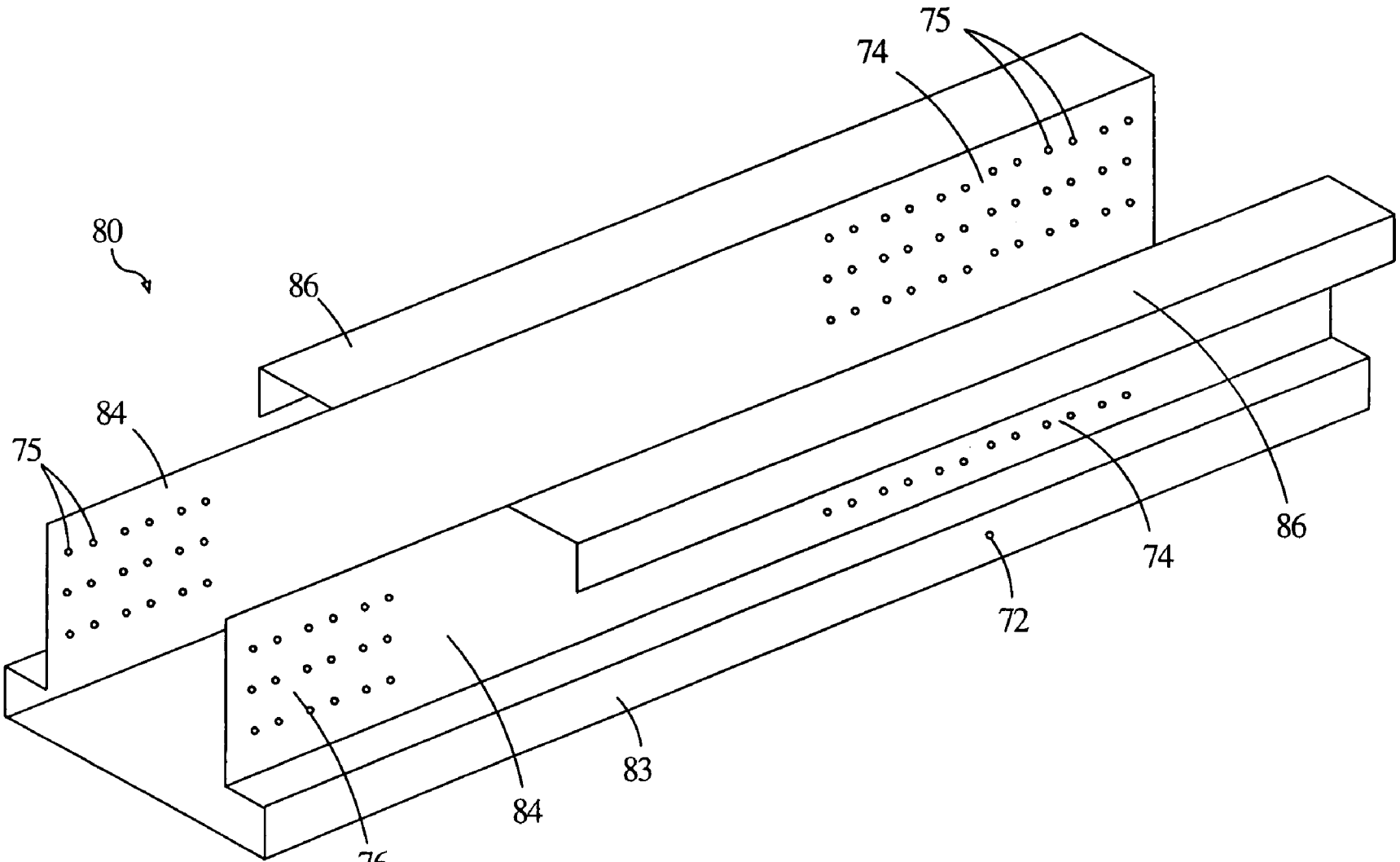
FIG. 6 illustrates an elongated structural chord member formed from the blank illustrated in FIG. 5.

FIG. 5 illustrates an elongated sheet of light gauge metal forming the blank from which a plurality of chord members may be formed. FIG. 6 illustrates a chord member formed from the blank illustrated in FIG. 5. With reference to FIGS. 5 and 6, an elongated sheet of light gauge metal forms the chord member blank 70. The blank 70 may be marked with one or more pilot holes 72 along the length thereof to identify the locations for attachment of web members and facilitate quality control in the fabrication of the trusses. The pilot holes 72 are formed in the blank 70 so that when the chord member 80 is roll formed, the pilot holes 72 are located in the first outer face 83 of one or both legs of the chord member 80. The pilot holes may be formed in the blank by any conventional means such as drilling, stamping, or other conventional means.

The blank 70 may also include one or more spaced apart apertured portions 74 along the length thereof and one or more apertured portions 76 positioned where the blank 70 will be transversely cut (for example along line C—C) to form a plurality of chord members. The blank is typically cut after being rolled to form the chord members. The apertured portions 74 are positioned in the blank so that when the chord member 80 is formed from the blank the apertured portions 74,76 are located along the web attachment faces 84 of each leg. The apertured portions 74,76 include a plurality of apertures 75 to facilitate the attachment of the chord member 80 to structural members received between the web attachment faces 84. The position of the apertured portions 74 along the length of the blank 70 is determined by the desired positions along the length of the chord member 80 for attachment to one or more web members. The apertures may be formed in the blank by any conventional means such as drilling, stamping, or other conventional means.

With further reference to FIG. 6, in the preferred embodiment of a chord member according to the present invention, the apertured portions 74 include a grid of apertures 75 extending a sufficient length along the length of the web attachment faces 84 to facilitate attachment to one or more web members positioned therebetween. A pilot hole 72 is typically located along the first outer face 83 adjacent the apertured portion 74 of the web attachment face 84 and is centered longitudinally along the apertured portion 74. Each end portion of the chord member 80 includes an apertured portion 76 to facilitate attachment of the end portion of the chord member to other structural members. The stiffening flange 86 may terminate at a point spaced from the end of the chord member 80 to facilitate the attachment of the chord member to another chord member.

With further reference to FIG. 5, an elongated portion of the blank 70 may be removed from each longitudinal edge 71 thereof to form notched portions 75 along the length of the blank 70. The notched portions 75 are positioned along the length of the blank 70 at the locations where the blank 70 will be transversely cut once rolled to form a plurality of chord members. The blank 70 is rolled to form the chord member 80 so that the stiffening flange 86 terminates along the notched portions 75 of the blank 70. When the rolled blank is cut transversely along the notched portion thereof, a pair of chord members 80 are formed wherein the stiffening flange 86 terminates at a point spaced form the end of the chord member formed by the transverse cutting of the blank. The notched portions 75 may be formed by any conventional means such as stamping, cutting, or other conventional means.

Figure 7:
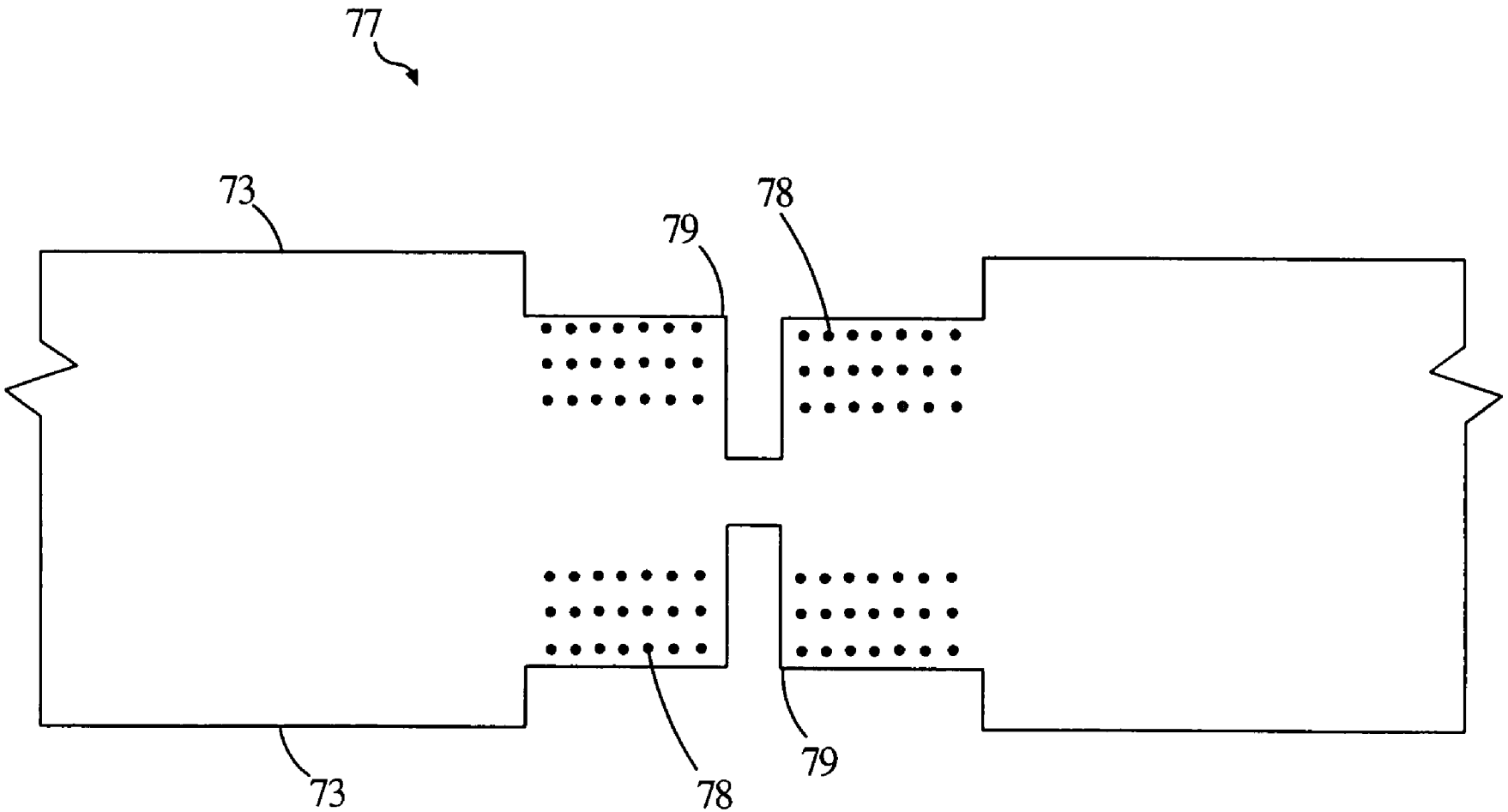
FIG. 7 is an illustration of another embodiment of a section of a light gauge metal blank according to the present invention.

FIG. 7 illustrates another embodiment of the chord member according to the present invention. With reference to FIG. 7, the apertured portion 78 extends along the entire length of the notched portion 79 of the blank 77. The notched portions 79 include "T" shaped notches formed along each edge 73 of the blank 77 to facilitate the transverse cutting of the blank to form a plurality of chord members.

In addition to the structural advantages over the prior art of the cross-sectional configuration of the chord member according to the present invention, the configuration provides many advantages in the use of various fixtures in the truss system. For example, in many applications it is desirable to provide resistance to uplifting forces such as wind. With reference to FIG. 2, the truss chord member 30 according to the present invention comprises in cross section a pair of lateral faces 44, each interconnecting the first outer face 38 with the web attachment face 40 in each leg 34. Because the lateral face 44 in each leg extends at a substantially right angle to the outer face 38 and the web attachment face 40, a simple truss clip having faces forming a substantially right angle may be used to provide resistance to uplifting forces.

Figure 8B:
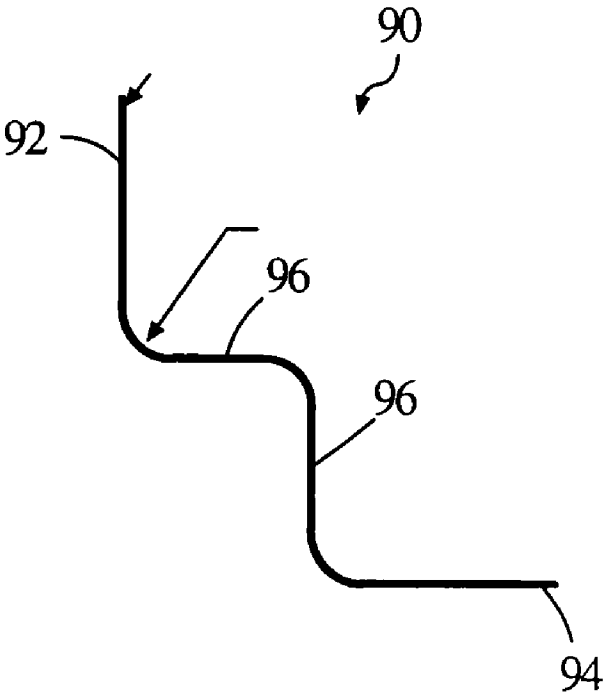
FIGS. 8*a* and 8*b* is an illustration of one embodiment of a truss clip according to the present invention.
Figure 8A:
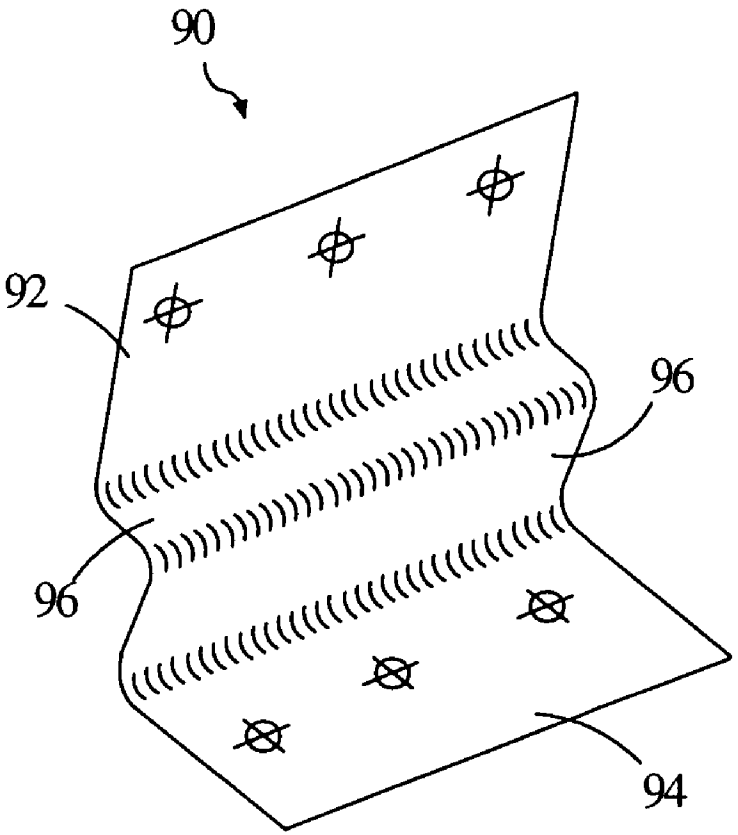
Figure 8C:
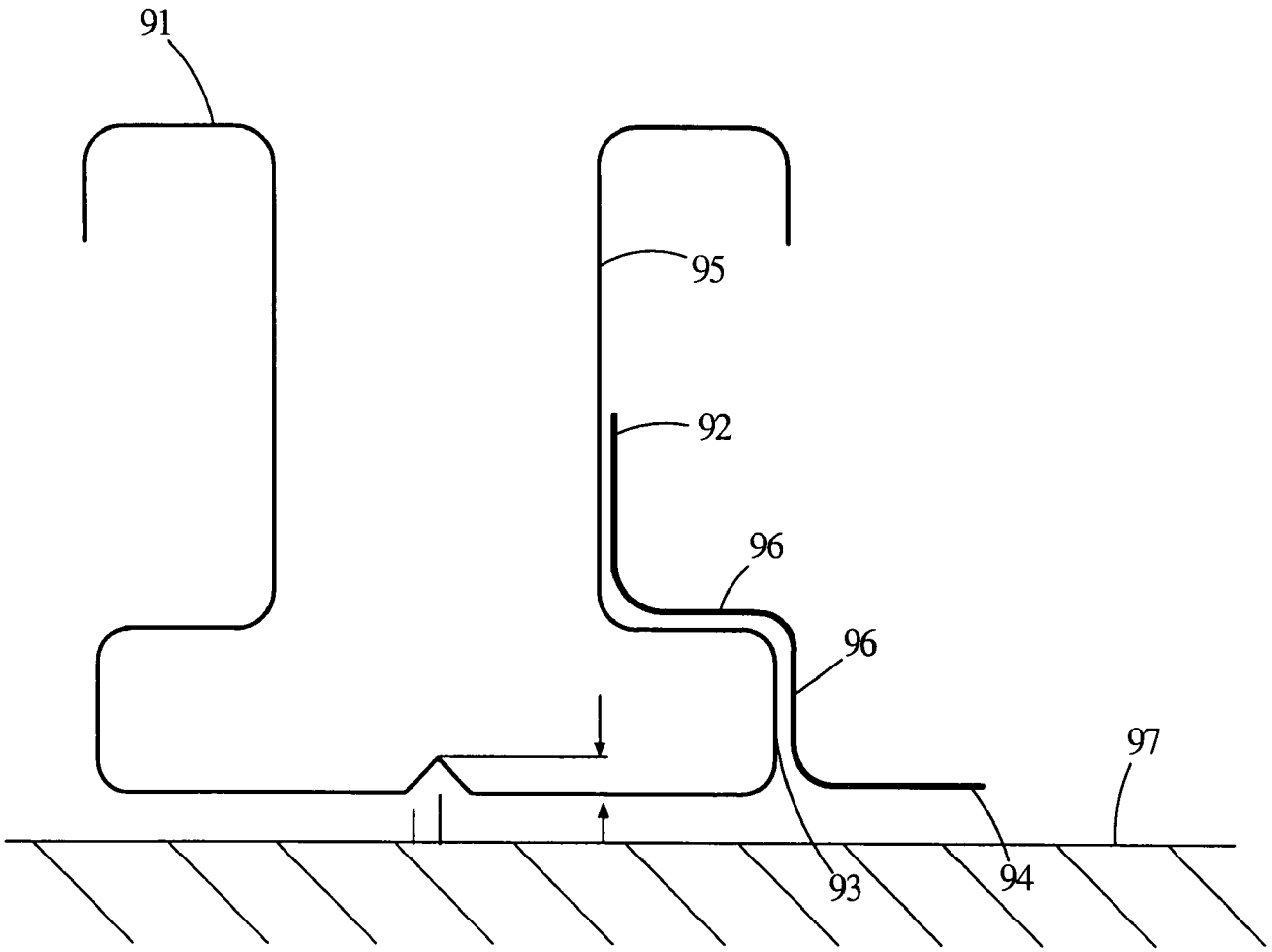
FIG. 8*c* illustrates the engagement of the truss clip illustrated in FIGS. 8*a* and 8*b* with one embodiment of a truss chord member according to the present invention.

FIGS. 8*a* and 8*b* illustrate a truss clip according to the present invention. With reference to FIGS. 8*a* and 8*b*, the truss clip 90 is an elongated roll formed structural clip of light gauge metal. The clip 90 comprises in cross-section a pair of substantially perpendicular attachment faces 92,94 interconnected by a pair of substantially perpendicular chord engagement faces 96. With reference to FIG. 8*c*, the chord engagement faces 96 form a substantially right angle groove adapted to receive the base portion 93 of the chord member 91 extending outward from the web attachment face 95 thereof so that the first attachment face 92 may be attached to the substantially vertical web attachment face 95 and the second attachment face 94 may be attached to the substantially horizontal surface 97 supporting the chord member 91. Upward movement of the truss is thereby restricted by the clip 90.

Figure 9B:
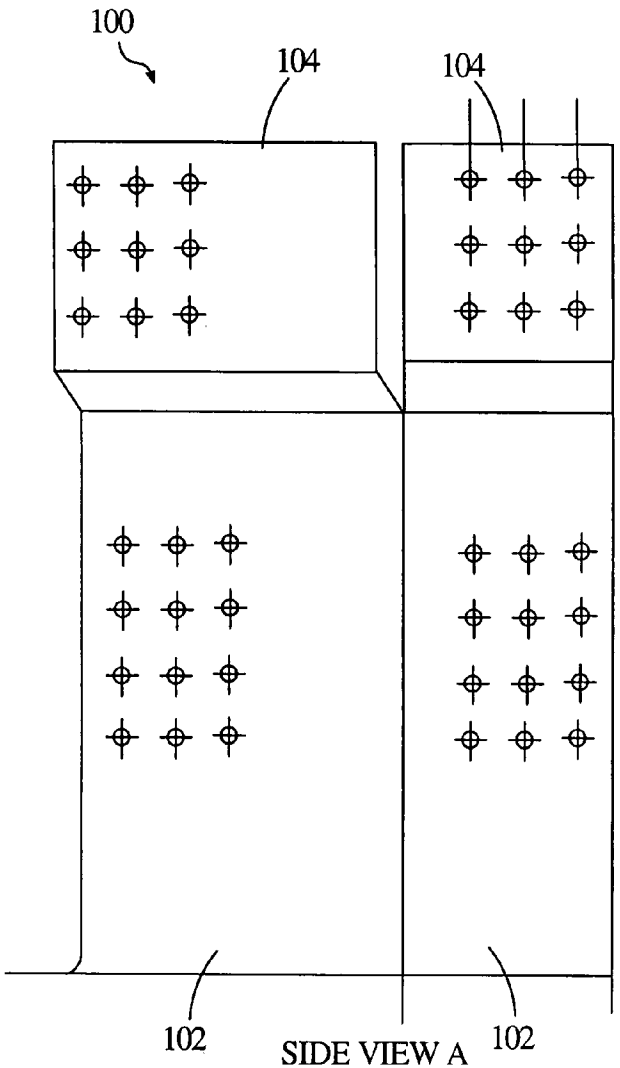
FIG. 9 is an illustration of one embodiment of a truss jack clip according to the present invention.
Figure 9A:
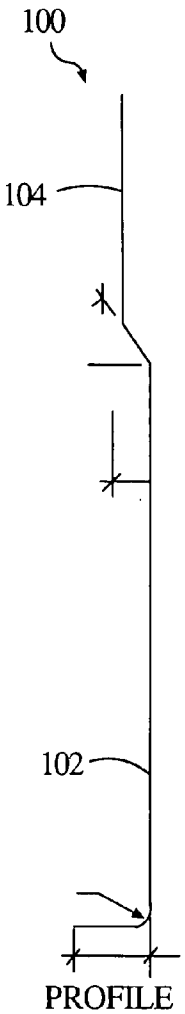

In the construction of commercial and residential buildings, it is often desirable to adjoin abutting trusses, e.g., as in the formation of a hip. FIGS. 9*a* and 9*b* illustrate a truss jack clip according to the present invention for attaching two trusses. With reference to FIGS. 9*a* and 9*b*, the jack clip 100 is formed from light gauge metal and comprises a pair of plates 102, each adapted to overlie a leg of a truss chord member. The plates 102 are disposed at a predetermined angle such as 90° or 135° relative to each other, depending on the relative angle of the abutting trusses. A recessed attachment face 104 extends from the upper edge of each plate 102 and is adapted to overlie a web member of the truss for attachment thereto. The jack clip 100 may be easily attached to web members of the trusses and thus the attachment thereto will not interfere with the attachment of the web members to the web attachment faces of the chord members. If necessary, the plates may be attached to the web attachment face of the chord member it overlies. The attachment faces and the plates may be apertured to facilitate attachment to the truss.

Figure 10:
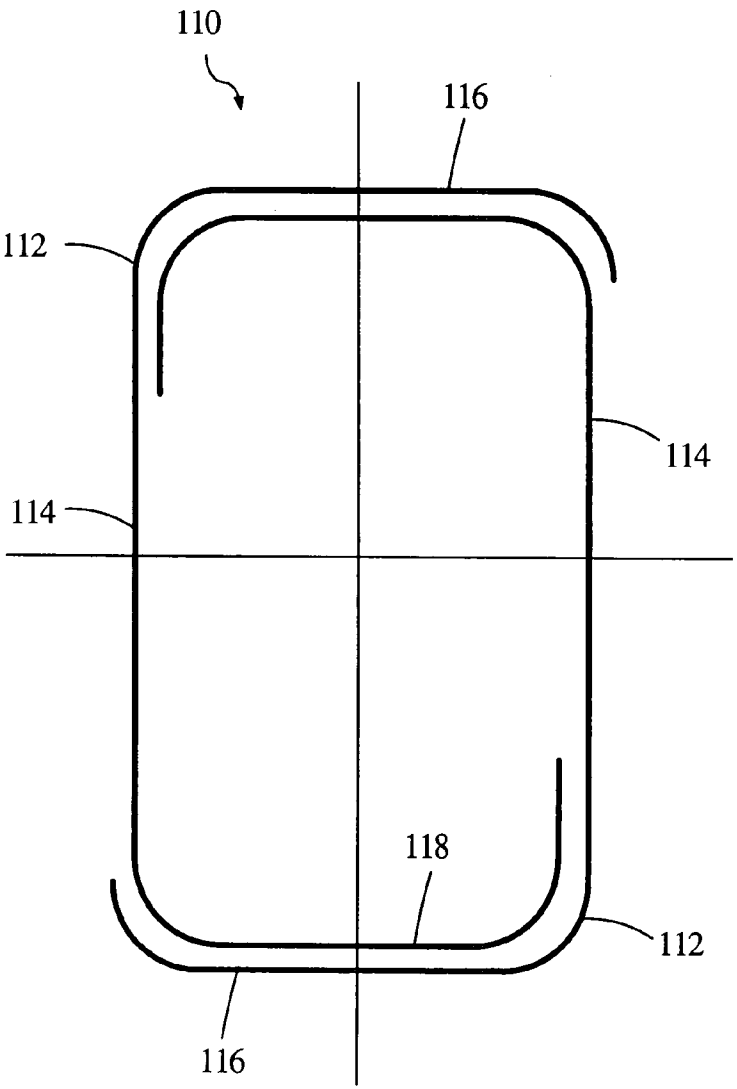
FIG. 10 is an illustration of one embodiment of an elongated structural web member in cross section according to the present invention.
Figure 11:
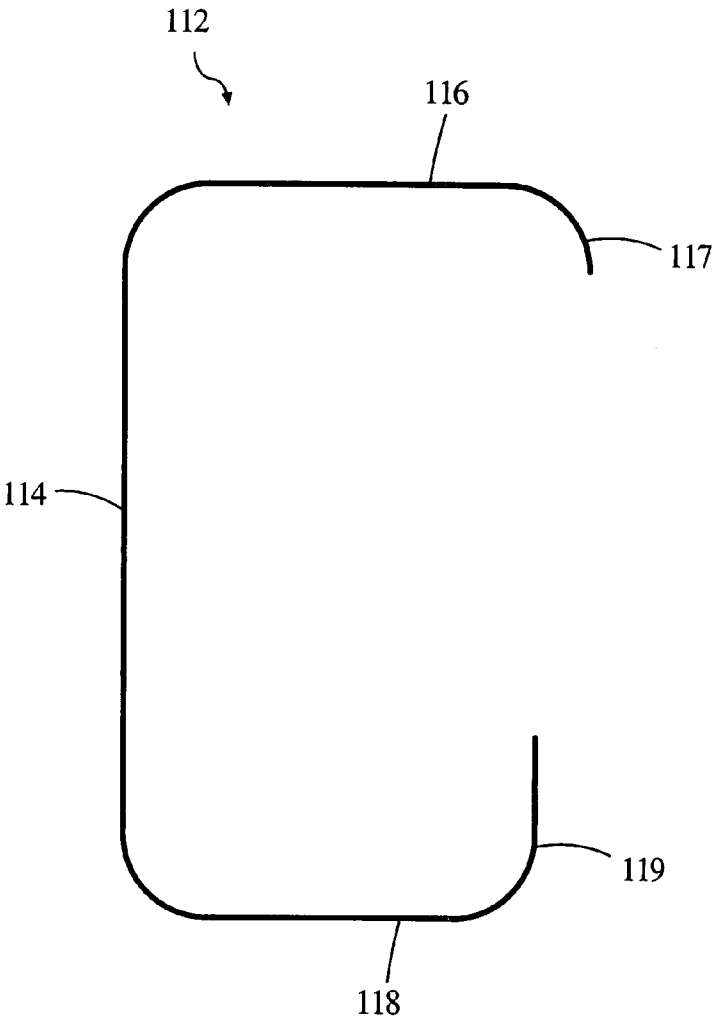
FIG. 11 is an illustration of an elongated structural member in cross section used to form the web member illustrated in FIG. 10.

FIG. 10 illustrates one embodiment of an elongated truss web member according to the present invention. FIG. 11 illustrates an elongated structural member for forming the web member of FIG. 10. With reference to FIGS. 10 and 11, the truss web member 110 is an elongated structural member having a generally box-shaped cross section. The web member 100 is formed by nesting two elongated structural members 112. Each of the structural members 112 comprises in cross section a web 114 and a pair of flanges 116,118 extending from the longitudinal edges thereof at a substantially right angle thereto. Each of the flanges 116,118 terminates in an inwardly turned lip 117,119 extending toward the other flange 118,116. One of the flanges 116 extends farther from the web 114 than the other of the flanges 118. The structural members are nested so that the shorter flange 118 of each member 112 is adjacent to and inside of the longer flange 116 to form a generally box-shaped structural web member 110. The nested members 112 may be secured by any conventional means such as screws or rivets.

The structural members 112 may be roll formed from light gauge metal. Thus the present invention provides a web member having the advantages of a member with a box-shaped cross section, e.g., the elimination of two modes of failure in compression, which may be easily fabricated in different sizes and gauges of metal.

The web member according to the present invention provides great flexibility in the design of trusses. The web members 110 may be fabricated to withstand the heavy load bearing requirements of long span trusses wherein the throat of the chord members is greater than one and one-half inches. The longer flange 116 is sized to fit within the throat of the truss chord member. For example, a truss web member 110 wherein the distance from the outer surface of the web 114 to the outer surface of the lip 117 is about one and ninety-five one-hundredths of an inch (i.e., the depth of the web member) is adapted to fit a truss chord member having a throat width of two inches. The longitudinal width of the web 114 may vary according to the structural requirements of the specific truss application. The width may be as narrow as about two and one-half inches or as wide as about fourteen inches. Web members which are narrower or wider may also be fabricated if the specific application requires. Generally, the ratio of the width of the web 114 relative to the depth of the member ranges between about two and seven inclusive.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A substantially flat elongated sheet of light gauge metal having a nominal width from which one or more truss chord members may be formed, said sheet comprising along the length thereof one or more pairs of opposing notches, the portion of said sheet intermediate each of said pairs of opposing notches forming a respective narrow portion, wherein at least one of said narrow portions includes a grid of apertures and wherein at least one of said narrow portions being intermediate portions of said sheet of nominal width.

2. The sheet of claim 1 wherein said grid of apertures is at least six inches long.

3. The sheet of claim 1 wherein said grid of apertures includes at least twenty spaced apart apertures.

4. A blank from which one or more truss chord members may be formed, said blank comprising a substantially flat elongated sheet of light gauge metal having at least two wide portions with substantially parallel longitudinal edges and a narrow portion intermediate said wide portions, said narrow portion having substantially parallel longitudinal edges each spaced from the central longitudinal axis of said sheet a distance less than the longitudinal edges of said wide portions are spaced from said central longitudinal axis, said narrow portion including a grid of apertures.

5. The blank of claim 4 wherein said grid of apertures is disposed substantially adjacent to at least one of the longitudinal edges of said narrow portion.

6. The blank of claim 4 wherein said grid of apertures is at least six inches long.

7. The blank of claim 4 wherein said grid of apertures includes at least twenty spaced apart apertures.

8. The blank of claim 4 wherein at least one of said wide portions includes a further grid of apertures.

9. The blank of claim 4 wherein said grid of apertures is disposed between one of said longitudinal edges of said narrow portion and the longitudinal axis of said sheet; said blank further comprising a second grid of apertures disposed between the other longitudinal edge of said narrow portion and the longitudinal axis of said sheet.

10. The blank of claim 4 comprising a pair of aperture grids positioned substantially symmetrically about the longitudinal axis of said sheet.

11. The blank of claim 4 comprising at least one aperture disposed symmetrically about the longitudinal axis of said sheet with one of the apertures in said grid of apertures.

12. The blank of claim 4 wherein said narrow portion has a pair of opposing notches disposed along the length thereof.

* * * * *